US006491214B2

(12) United States Patent
Plummer et al.

(10) Patent No.: US 6,491,214 B2
(45) **Date of Patent: *Dec. 10, 2002**

(54) MULTI-PLY FOOD CONTAINER

(75) Inventors: Wendy L. Plummer, Madeira, OH (US); John William Toussant, West Chester, OH (US); Karen K. Leeker, Cincinnati, OH (US); Bruce N. Hall, Cincinnati, OH (US); Garold W. Alexander, Lewis Center, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/061,955

(22) Filed: Apr. 17, 1998

(65) Prior Publication Data

US 2002/0074390 A1 Jun. 20, 2002

(51) Int. Cl.[7] ..... B65D 3/22

(52) U.S. Cl. ..... 229/406; 220/62.2; 220/574; 229/407; 229/939

(58) Field of Search ..... 229/406, 407, 229/939, 122.32, 403; 220/62.13, 62.18, 62.2, 574, 574.3

(56) References Cited

U.S. PATENT DOCUMENTS

| | | | | |
|---|---|---|---|---|
| 3,033,434 A | | 5/1962 | Carson | |
| 3,596,822 A | | 8/1971 | Holley | |
| 3,720,365 A | * | 3/1973 | Unger | 229/406 |
| 4,026,458 A | | 5/1977 | Morris et al. | |
| 4,441,626 A | | 4/1984 | Hall | |
| 4,606,496 A | | 8/1986 | Marx et al. | |
| 4,609,140 A | | 9/1986 | Van Handel et al. | |
| 4,721,499 A | | 1/1988 | Marx et al. | |
| 4,721,500 A | | 1/1988 | Van Handel et al. | |
| 4,848,543 A | | 7/1989 | Doboze | |
| 4,950,524 A | | 8/1990 | Hacker | |

(List continued on next page.)

FOREIGN PATENT DOCUMENTS

| | | | | |
|---|---|---|---|---|
| AU | PL1153 | | 3/1992 | |
| DE | 2104796 | * | 8/1972 | 229/939 |
| DE | 22 47 151 A | | 3/1974 | |
| DE | 296 02 348 U1 | | 3/1986 | |
| DE | 029602348 U1 | | 5/1996 | |
| GB | 2 302 533 | | 1/1997 | |
| WO | WO 93/23294 | | 11/1993 | |
| WO | WO 95/35204 | | 12/1995 | |

OTHER PUBLICATIONS

1982. Employee pressformed corrugated materials into a food container.

Feb.–Mar. 1997. Gralex shared corrugated food containers with customer.

Mar. 1997. Gralex shipped corrugated food containers outside the U.S.

Advertisement by Spectra–kote Corporation, Gettysburg, PA showing a Corro Tray™.

*Primary Examiner*—Gary E. Elkins
(74) *Attorney, Agent, or Firm*—Larry L. Huston; Steven W. Miller

(57) ABSTRACT

A food container comprising three or more plies, a first ply, a second ply, and at least a third ply. The first ply is oriented towards the hands and face of the user and receives food in use. The first ply is essentially continuous throughout its plane. The third ply is oriented towards the lap of the user or a table top in use. The second ply spaces the first and third plies apart. In a preferred embodiment, the food container may be made of a corrugated material. The food container may be made from a blank which is deformed out of its plane during manufacture.

20 Claims, 2 Drawing Sheets

U.S. PATENT DOCUMENTS 4,993,580 A * 2/1991 Smith ..... 229/939
5,000,372 A * 3/1991 Hollander et al. ..... 229/122.32
5,094,385 A 3/1992 Antczak
5,205,476 A 4/1993 Sorenson
5,230,939 A 7/1993 Baum
5,279,456 A 1/1994 Bernstein
5,326,020 A 7/1994 Cheshire et al.
5,577,989 A 11/1996 Neary
5,662,240 A 9/1997 Norris
5,769,311 A * 6/1998 Morita et al. ..... 229/403
5,772,111 A * 6/1998 Kirsch ..... 229/939

* cited by examiner

MULTI-PLY FOOD CONTAINER

FIELD OF THE INVENTION

This invention relates to food containers, particularly a food container which may be disposable, and more particularly a food container which comprises multiple plies.

BACKGROUND OF THE INVENTION

Disposable food containers are well known in the art. Disposable food containers include common paper plates, bowls, clam shells, trays, etc.

The art has paid considerable attention to making, molding, and deforming these food containers out of a single plane. In this latter process a blank is provided. The blank is inserted between mating platens and pressed. The blank may have radial grooves at its periphery. The radial grooves provide for accumulation of the material deformed by the platens. Exemplary art includes U.S. Pat. No. 3,033,434, issued May 8, 1962 to Carson; U.S. Pat. No. 4,026,458, issued May 31, 1977 to Morris et al., the disclosures of which are incorporated herein by reference; U.S. Pat. No. 4,606,496, issued Aug. 19, 1986 to Marx et al.; U.S. Pat. No. 4,609,140, issued Sep. 2, 1986 to van Handel et al.; U.S. Pat. No. 4,721,500, issued Jan. 26, 1988 to van Handel et al.; U.S. Pat. No. 5,230,939, issued Jul. 27, 1993 to Baum; and U.S. Pat. No. 5,326,020, issued Jul. 5, 1994 to Cheshire et al.

The blanks are typically comprised of paperboard, and more particularly a single sheet of paperboard, as illustrated in the aforementioned patents. A single sheet of paperboard is utilized due to the belief that to deform the blank out of its plane the blank must be thin and of a single ply. The paperboard, or other material used for the blank, is typically substantially homogeneous, as illustrated by U.S. Pat. No. 4,721,499 issued Jan. 26, 1988 to Marx et al. It is believed that homogeneity aids in the radially symmetric deformation of round food containers, such as plates and bowls.

However, these attempts in the art suffer from several drawbacks. As illustrated by the plethora of attempts to improve the rigidity and stability of the food containers, the prior art attempts do not provide food containers of sufficient strength. This lack of strength leads to spillage of food when the food container becomes overloaded, or, alternatively, unduly constrains the amount of foods which can be placed on the food container at a given time.

Yet another disadvantage occurs with the single ply paperboard food containers of the prior art. The relatively thin single ply paperboard provides only minimal thermal insulation. When warm food is placed on the food container, little insulation is provided, allowing the food to cool. Cooling occurs due to heat transfer through the food container to the surface below, or to the atmosphere.

What is needed in the art, therefore, is a food container providing increased strength, rigidity, and thermal insulation. One potential solution is to increase the thickness of the blank. However, this increase is accompanied by an often unacceptable increase in material costs, since the material costs are proportional to the basis weight of the blank.

Thus, there exists a need in the art for a food container having the aforementioned properties but without undue material costs. Furthermore, the blank for such a food container must be readily deformable out of its plane.

One attempt in the art to overcome this trade off is to use multi-ply laminate food containers. For example, it is known in the art to make food containers out of corrugated laminates. Such food containers have panels which are typically scored and folded as illustrated by U.S. Pat. No. 5,205,476 issued Apr. 27, 1993 to Sorenson. However, this scored and folded food containers require a costly folding apparatus and are inherently unreliable. Adjacent panels in the food container are defined by cuts or score lines. The adjacent panels are then foldably connected. After adjacent panels are foldably connected, they must be adhesively joined or mechanically interlocked to remain in place. The adhesive and its associated application apparatus represent additional capital costs and ongoing material costs. Mechanical materials have tabs. The tabs require cutting/slitting operations and are inherently unreliable. The tabs become disengaged, torn, or simply misaligned.

One attempt in the art to overcome this deficiency is to use single faced corrugated materials and continuously form rather than score, cut and fold the food container as illustrated by U.S. Pat. No. 5,577,989 issued Nov. 26, 1996 to Neary. Continuously formed food containers have peripheral sections which are raised gradually and continuously through a transition area relative to the central region of the food container. However, single faced corrugated materials have neither the strength nor the insulating capability of three ply corrugated materials. Neary acknowledges that the industry had been unable to create a satisfactory unitary construnction by stamping corrugated paperboard of more than two plies.

However, these deficiencies in the prior art are overcome by the present invention. The present invention provides multi-planar food containers made, in one embodiment, of three ply corrugated materials without relying upon the score, cut and fold techniques of the prior art.

SUMMARY OF THE INVENTION

The invention comprises a multi-ply food container having an XY plane and a Z-direction orthoganol thereto. A multi-ply food container comprises at least three plies, a first ply, a second ply and a third ply. A second ply is interposed between the first ply and the third ply, so that the first and third plies are spaced apart from each other by the second ply. The second plies provides an air space between the first and third ply. The air space may help in reducing heat transfer through the food container. The food container is multi-planar and has first and second portions spaced apart in the Z-direction. The first and second spaced apart portions are connected by a continuous transition region.

In a preferred embodiment, the second ply comprises a corrugated medium. However, it will be recognized that any embodiment which provides discrete, semi-continuous or continuous spacers in the second ply and which spaces apart the first and third plies is suitable with the present invention.

DETAILED DESCRIPTION OF THE INVENTION

Figure 1:
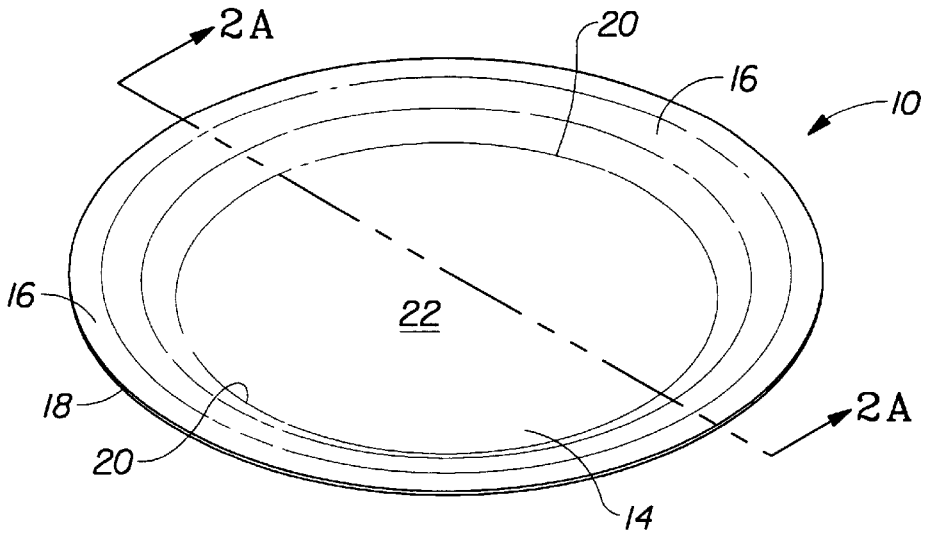
FIG. 1 is a perspective view of one embodiment of a food container according to the present invention.
Figure 2A:
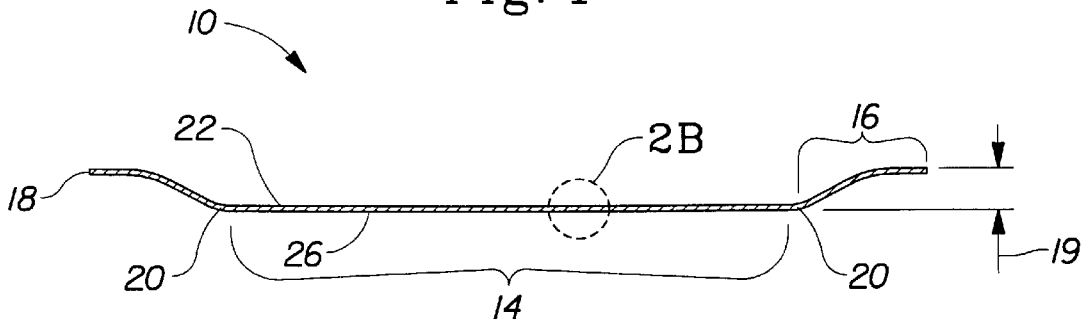
FIG. 2A is a vertical sectional view taken along the lines 2A—2A of FIG. 1.

Referring to FIGS. 1–2A, the food container 10 according to the present invention may comprise a plate, a bowl, a tray, a clam shell, or any other configuration known in the art.

The food container 10 comprises a central region 14 and a circumjacent periphery 16. The central region 14 and periphery 16 are disposed in two different planes. The central region defines the XY plane of the food container 10. The Z-direction of the food container 10 lies perpendicular to the XY plane. The food container 10 will necessarily have a transition region 20 from the central region 14 to the periphery 16. In normal use, the periphery 16 is typically raised relative to the central region 14.

The food container 10 comprises three plies: a first ply 22, a second ply 24 and a third ply 26. The second ply 24 spaces the first and third plies 22, 26 apart in the Z-direction.

It is not necessary that either the central region 14 or the periphery 16 be parallel to the XY plane or generally planar. For example, bowls having a generally concave shaped bottom will be suitable for use with the present invention. It is only necessary that the central region 14 and the periphery 16 be spaced apart in the Z-direction. The Z-direction distance from the bottom surface of the central region 14 (taken while the food container 10 is in its normal in-use and generally horizontal position) to the top surface of the periphery 16 as the referred as to the Z-direction depth 19 of the food container 10. If there are different depths at different portions of the food container 10, the Z-direction depth is taken as that greatest Z-direction distance.

The boundary and shape of the periphery 16 are defined by the edge 18 of the food container 10. It is to be recognized that the dimensions and relative proportions of the periphery 16 and central region 14 of the food container 10 will vary according to the exact size and intended use of the food container 10. While a round food container 10 is illustrated in FIG. 1, one of ordinary skill will recognize that any suitable shape and depth of food container 10 may be selected for use with the present invention and the invention is not so limited. Other suitable shapes include squares, rectangles, ovals, various polygons, etc.

The food container 10 according to the present invention may be made of any rigid material, particularly a material which provides for the intended use of storing, cooking, dispensing and eating foods therefrom. The food container 10 may be made of cellulose, such as solid bleached sulfite paperboard and various types of wood fibers, including recycled fibers. Alternatively, suitable rigid materials for the food container 10 include foam, plastic and other synthetic materials, and aluminum foil.

One of ordinary skill will recognize that it is not necessary that the first, second and third plies 22, 24, 26 be made of identical material. The first ply 22 needs to be sanitary and preferably aesthetically pleasing to the consumer. However, the second and third plies 24, 26 are not so limited. The said second and third plies 24, 26 may be chosen for strength, aesthetic properties and cost reduction.

If desired, one or more of the plies 22, 24, 26 may be treated with re-enforcing material, as is well known in the art. If only one ply 22, 24 or 26 is treated for strength, preferably it is the second ply 24. The second ply 24 may have increased strength because the second ply 24 transmits compressive and bending loads applied to the food container 10.

For example, The second ply 24 may be treated with epoxy or other synthetic resins as is well known in the art. Additionally or alternatively, the second ply 24 may be treated or impregnated with lignin as is well known in the art. It will be apparent to one of ordinary skill that various other means may be used to strengthen one or more of the plies 22, 24, 26 as is well known in the art. For example, radial reinforcing ribs (not shown) may be applied to the underside of the food container 10 and joined to the third ply 26. Such reinforcing ribs will distribute loads applied near the center of the food container 10 towards the edge 18 of the food container 10.

As illustrated in FIGS. 1 and 2A, the food container 10 is multi-planar. By multi-planar, it is meant that different portions of the food container 10 lie in different planes. An example of the multi-planarity of the food container 10 of the present invention is illustrated by the central region 14 and periphery 16 of the food container 10. The central region 14 and periphery 16 of the food container 10 are spaced apart in the Z-direction, thus rendering the food container 10 multi-planar. As noted above, typically, but not necessarily, the periphery 16 will be raised relative to the central region 14 while the food container 10 is in use.

Often times, differences in Z-direction elevation of the food container 10 will occur as a function of the radial position within the food container 10. However, the invention is not so limited. Differences in Z-direction elevation may occur as a function of circumferential position on the food container 10 as well. The present invention is not limited to axisymmetric food containers 10 or food containers 10 which are symmetric about any particular plane.

The multi-planar food container 10 has at least one continuous transition region 20 between the different portions of the food container 10 which are spaced apart in the Z-direction. By "continuous transitions region 20" it is meant that the deviations or changes in Z-direction position occur without fold lines, cuts, scores or perforations. In a planar sense, the absence of fold lines, cut, scores or perforations means that there will be no vertex where the elevation of the food container 10 changes in the Z-direction. A vertex is considered to be any point in the cross-section where there is an abrupt, rather than continuous change in the Z-direction elevation. For the embodiments illustrated in the figures, changes in Z-direction elevation occur as a function of the radial position within the food container 10.

It may be necessary to accommodate the accumulation of material which occurs when the food container 10 is formed with one or more continuous transition regions 20. Pleats or gathers are often used for this purpose. Pleats and gathers, particularly accumulation pleats having a radial orientation, are contemplated and within the scope of the present invention. Such pleats and gathers are transverse to the transition region 20, and do not violate the requirement or definition of a continuous transition region 20.

It is to be recognized the aforementioned accumulation pleats do not form part of the Z-direction spacing. The accumulation pleats simply prevent a multiple thickness of the corrugated medium from occurring at corners, adjacent folds, etc. Such a multiple thickness of material generally represents excess material usage and increases the cost of the food container 10. A particularly notable feature of a preferred embodiment of the food container 10 according to the present invention is the absence of overlapping flaps or panels adhesively or otherwise joined together and which form part of the Z-direction spacing of the present invention.

The Z-direction spacing in the present invention is provided by a continuous transition region 20. The continuous transition region 20 obviates the necessity of fold lines, scores, cuts or perforations, although they may be provided as a strictly ancillary feature, as, for example, in the prior art pleats and gathers which provide regular and spaced gathering points for excess material as the food container 10 is formed. The prior art pleats and gathers accommodate material deformed during the manufacturing process, but do not affect transitions between different Z-direction elevations of different portions of the food container.

Such pleats and gathers are typically transverse to the transition region 20. In contrast, the prior art cuts, scores and fold lines, are parallel to the transition region 20. Cuts, scores and fold lines parallel to the transition region 20 are absent from the food container 10 of the present invention.

The continuous transition region 20 of the present invention may be curvilinear in cross section. A curvilinear continuous transition region 20 may have a radius of curvature of at least 5 millimeters, although suitable transition regions 20 may have radii of curvature ranging from 1 to 25 millimeters. A preferred range for the radius of curvature is from 1 to 10 millimeters. The radius of curvature is measured at the outwardly facing surface of the first ply 22.

Figure 2B:
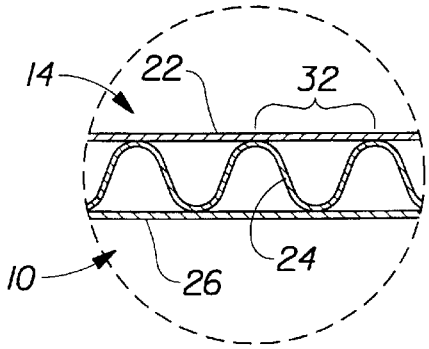
FIG. 2B is a fragmentary enlarged view of FIG. 2A.

Referring to FIGS. 2A–2B, the food container 10 comprises a multi-ply laminate. Preferably the laminate comprises three plies, a first ply 22, a second ply 24, and a third ply 26. However, constructions of more than three plies are contemplated and within the scope of the present invention. The first and third plies 22, 26 are the outboard plies and form the oppositely disposed and outwardly facing surfaces of the food container 10. The second ply 24 is sandwiched between the first and third plies 22, 26.

The first ply 22 and, for the embodiments described and illustrated in the figures, the third ply 26, are smooth. The first ply 22 faces the user and has food, etc. placed thereon in use. The third ply 26 may be textured to reduce slippage during use. By smooth it is meant that the first ply 22 and third ply 26 are macroscopically continuous in the XY plane and are not rough to the touch.

The first ply 22 allows for ready removal of the food during eating, heating and other preparation, storage, etc. The third ply 26 allows for convenient holding of the food container 10 in one's hand, lap, on a table, etc. The first ply 22 and/or third ply 26 may be printed or coated. Printing may provide indicia. The coating may provide a sanitary or moisture impervius eating surface.

The second ply 24 is discontinuously joined to at least one of the first or third plies 22, 26 and spaces the first and third plies 22, 26 apart from each other in the Z-direction. The second ply 24 thereby allows air, or other insulating materials such as foam, etc. to be interposed between the first ply 22 and third ply 26.

Figure 4:
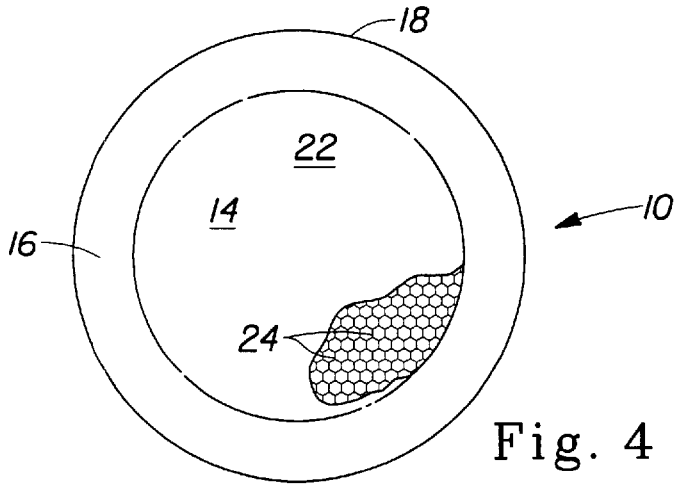
FIG. 4 is a top plan view, shown partially in cutaway, of a food container according to the present invention having an intermediate ply which comprises a honeycomb material.

The second ply 24 may comprise any configuration which separates the first and third plies 22, 26 in the Z-direction with discontinuities therebetween. For example, the second ply 24 may comprise a series of spacers, which may be discretely spaced from each other in the XY plane. The spacers comprising the second ply 24 may also be semi-continuous, i.e., extending substantially throughout one direction in the XY plane. Honeycomb materials may also be used for the second ply 24, as shown in FIG. 4.

The spacers, honeycomb materials, etc. prevent the first and third plies 22, 26 from contacting each other throughout the entirety of the XY plane. Thus, the first and third plies 22, 26 are only connected to one another at the locations where the spacers join the first and third plies 22, 26. The spacers may be adhesively joined to the oppositely disposed first and third plies 22, 26, heat sealed to the first and third plies 22, 26, etc. depending upon the selection of the materials used for construction of the plies 22, 26.

Referring back to FIGS. 2A–2B, preferably the food container 10 comprises a corrugated construction as is well known in the art. A corrugated construction comprises first or third outer plies 22, 26 and a corrugated ply 24 therebetween. The corrugated ply 24 is not joined at all positions to the outer plies 22, 26, but instead has corrugations 32 comprising troughs and ribs which are spaced apart from the flat plies 22, 26. The ribs and troughs are often straight and parallel. In cross section, the ribs may be S-shaped, C-shaped, Z-shaped, or have any other configuration known in the art.

Suitable corrugated materials range from A to N size flutes, with E to N size flutes being preferred. A particularly preferred corrugated medium comprises a wave flute. A wave flute corrugated medium has corrugations 32 with vector components parallel to both the X and Y directions. This arrangement provides the laminate with properties which are more nearly equivalent in the X and Y directions. A particularly common wave flute corrugated medium has corrugations 32 which approximate a sinusoidal pattern.

The corrugated laminate, comprising all three plies 22, 24, 26, may have a combined basis weight of 100 to 1,000 grams per square meter, with a basis weight of 125 to 700 grams per square meter being preferred. While the corrugated material represents a preferred embodiment for the present invention, it is to be recognized that any construction of three or more plies 22, 24, 26, having the first and third plies 22, 26 spaced apart, and having a first ply 22 which is able to receive and dispense food is suitable.

The food container 10 may be formed by providing a multi-ply blank as described above. The multi-ply blank is deformed out of its plane by mating platens as is well known in the art. Exemplary apparatus suitable for deforming the blank into a three dimensional food container 10 are illustrated by U.S. Pat. No. 2,832,522 issued Apr. 29, 1958 to Schlanger; U.S. Pat. No. 2,997,927 issued Aug. 29, 1961 to Carson; U.S. Pat. No. 3,033,434 issued May 8, 1962 to Carson; U.S. Pat. No. 3,305,434 issued Feb. 21, 1967 to Bernier et al.; and U.S. Pat. No. 4,026,458 issued May 31, 1977 to Morris et al, and incorporated herein by reference.

The mating platens work by deforming the multi-ply blank out of its XY plane and in the Z-direction. The platens both clamp the blank and deform it in the Z-direction. Preferably, the blank is lightly clamped at its edge 18, corresponding to the periphery 16 of the food container 10. As the platens engage and deform the multi-ply blank in the Z-direction, the periphery 16 slips through the platens, due to the aforementioned light clamping force. Such slippage allows for Z-direction deflection in the blank, thereby preventing the blank from undue strain.

Importantly, in the process according to the present invention of making the food container 10, the mating platens deform the blank in the Z-direction, without the addition of moisture. The addition of moisture, beyond that present in the ambient, tends to produce tearing on the tension side of the blank during deformation in the Z-direction. Therefore, it is preferred that the process according to the present invention be carried out in the absence of added moisture—contrary to the teachings of the prior art, as illustrated, for example, by the aforementioned U.S. Pat. No. 5,557,989 issued to Neary.

The clearances between the mating platens may be provided such that there are no compressive loads applied to the central region 14 of the food container 10. However, the periphery 16 and other portions of the food container 10 may undergo compressive loading, particularly eccentric compressive loading, for deformation and strength.

Figure 3:
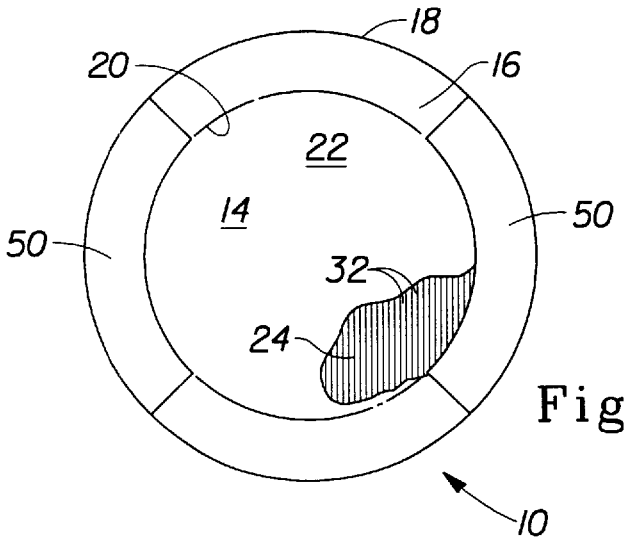
FIG. 3 is a top plan view of the shims used in the present invention superimposed on the food container, the food container being shown partially in cutaway to expose the corrugations of the second ply.

Referring to FIG. 3, if desired, the mating platens may be shimmed to prevent undue compression of the blank. The shims selectively provide compression to regions of the blank registered with the shims and prevent undue compression to other portions of the blank. If the second ply 24 has directional properties, as occurs with corrugated materials, the shims 50 may be eccentrically arranged in an azimuthal pattern which accommodates the directional properties of the second ply 24. Unexpectedly, the major axis of the shims 50 should be parallel to the major axis of the corrugations of the second ply 24.

This arrangement provides for more compression of the portions of the periphery 16 subtended by the shims than of the central region 14. Thus, the central region 14 will be thicker than the subtended portions of the periphery 16.

The shims 50 may have a thickness ranging from about 25 to about 75 percent, and preferably about 30 to 50 percent, of the thickness of the blank prior to be deformed by the mating platens. The shims 50 may taper to a lesser thickness at their ends or at the inside diameter.

The shims 50 may be disposed on sectors of a round food containers 10. The sectors may subtend an arc of 60° to 120°, and preferably about 90°, or one quadrant, of a round food container 10. If such an arrangement is selected, the shims 50 are diametrically opposed.

In a still more preferred embodiment, the platens of the mold are provided with eccentric sidewall clearances. The sidewall clearances perpendicular to the ribs of the corrugations 32 are greater than the sidewall clearances parallel to the ribs of the corrugations 32. Again, the eccentricity may continuously and gradually vary between adjacent 90° quadrants of the mold platens for a round food container 10. For the embodiments described herein, with a three ply laminate corrugated material having a basis weight of 100 to 1,000 grams per square meter, the clearances may vary from a minimum of about 0.01 to about 0.05 inches to a maximum of about 0.03 to about 0.09 inches.

If desired, the laminate forming the food container 10 may be sealed. By "sealed" it is meant that the space between the first and third plies 22, 26 is enclosed at the edge 18 of the food container 10. Sealing the laminate prevents or reduces convective currents between the first and third plies 22, 26. By preventing or reducing convective currents, thermal losses are reduced and the thermal insulting capability of the food container 10 is improved by sealing the edge 18. Additionally, depending upon the materials used for sealing, the strength and rigidity of the food container 10 may be improved. Furthermore, sealing the edge 18 of the food container 10 will likely improve its aesthetic appearance and hygiene.

Sealing the edge 18 of the food container 10 may be accomplished by adding a separate strip of material and adhesively joining it to the edge 18, by crimping the first and third plies 22, 26 together at the edge 18, by dipping the edge 18 in wax, painting a thick paint onto the edge 18, or using other known filler and sealer materials applied in any suitable manner.

If desired, the three plies 22, 24, 26 may be provided separately, rather than as a unitary laminate. The three plies 22, 24, 26 may often be joined together in the same process which deforms the blank into the multi-ply food container 10. This process provides the dual functionality of joining the plies 22, 24, 26 and deforming the multi-ply food container 10 in the Z-direction in a single operation.

Such a process may be accomplished as follows. The second ply 24 may have adhesive applied to those portions of the second ply 24 which contact the first and third plies 22, 26. For example, if a corrugated material is selected for the second ply 24, the crests of the ribs of the corrugations 32 may be adhesively coated. Adhesive may be applied to the crests of the ribs of the corrugations 32 by printing, as is well known in the art. Of course, it is not necessary that each corrugation 32 have adhesive applied thereto. For example, just alternate corrugations 32 or peripheral corrugations 32 could be adhesively coated, depending upon the lamination strength needed for the desired end use. Alternatively, the inner surfaces of the first and third plies 22, 26 may be adhesively coated. Suitable adhesives include pressure sensitive and starch based adhesives.

In an alternative embodiment, the inner surfaces of the first and third plies 22, 26 or, alternatively, the crest of the ribs of the corrugations 32 of the second ply 24 may be coated with a polymeric film. The first, second and third plies 22, 24, 26 are then joined together by heat sealing.

The three plies 22, 24, 26 are then compressed by the platens, as described above. The compression from the platens both joins the three plies 22, 24, 26 togthether and deforms the resulting laminate into a multi-ply food container 10. Alternatively, it may not be necessary to provide a separate adhesive to join the three plies 22, 24, 26 together. Prophetically, autogenious bonding or edge crimping may be used.

Alternatively, the first or third ply 22, 26 may be provided separately from the other two plies. The other two plies are joined together as provided. The three plies 22, 24, 26 are then compressed by the platens and at the same time all three plies 22, 24, 26 are joined together.

Figure 5:
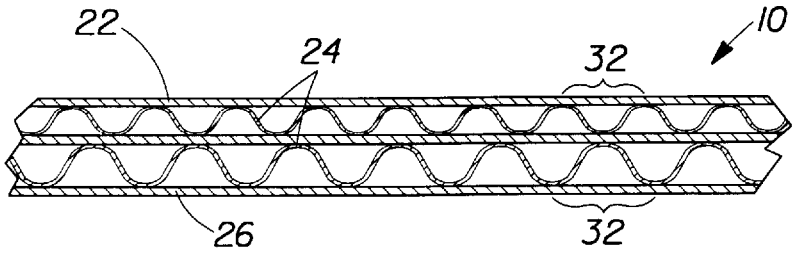
FIG. 5 is a vertical sectional view of a food container according to the present invention having multiple corrugated plies.

Referring to FIG. 5, laminates of more than three plies 22, 24, 26 may be utilized. For example, a five ply food container 10 having a sandwich of three smooth plies with two corrugated plies interposed therebetween may be utilized. Such an arrangement provides a thicker food container 10 than three comparable plies 22, 24, 26. If such an arrangement is selected, it is not necessary that the corrugations 32 of the two corrugated plies 24 be identical. The corrugations 32 may be differently sized.

Different corrugated plies may have straight and/or wave flutes in the corrugations. Alternatively, the intermediate plies 24 which space apart the smooth plies 22, 26 can be a combination of corrugated materials, honeycomb, discrete spacers, etc. Various other configurations will be recognizable to one of ordinary skill in the art.

REFERENCE NUMERALS

| Reference Numeral | Description |
|---|---|
| 10 | Food container |
| 14 | Central region |
| 16 | Periphery |
| 18 | Edge |
| 19 | Z-direction depth |
| 20 | Transition region |
| 22 | First ply |
| 24 | Second ply |

-continued

| Reference Numeral | Description |
|---|---|
| 26 | Third ply |
| 22, 26 | First and third plies |
| 32 | Corrugations |
| 50 | Shim(s) |

DR/11472/mutiplyfoodcontainer.doc

What is claimed is:

1. A multi-ply food container having an XY plane and a Z-direction orthogonal thereto, said multi-ply food container comprising a periphery and a central region, said periphery and said central region each having a thickness, said entire periphery being spaced apart in said Z-direction from said central region, said thickness throughout said central region being greater than the thickness of said periphery, said multi-ply food container comprising a laminate, said laminate consisting of three plies, a first ply, a second ply and a third ply, said second ply being interposed between said first ply and said third ply, whereby said first ply and said third ply are spaced apart from each other, said second ply providing for an air space between said first ply and said third ply, said laminate having a basis weight of 100–1000 grams per square meter, said food container being multi-planar and having first and second portions spaced apart in the Z-direction, said first and second portions being connected by a continuous transition region.

2. A multi-ply food container according to claim 1 wherein said second ply comprises a corrugated medium.

3. A multi-ply food container according to claim 2 wherein said second ply comprises a wave flute corrugated medium.

4. A multi-ply food container according to claim 1 wherein said central region is concave-shaped.

5. A multi-ply food container having an XY plane and a Z-direction orthogonal thereto, consisting of three plies, said food container comprising a periphery and a central region, said entire periphery being spaced apart in the Z-direction from said central region, said periphery and said central region each having a thickness, said entire central region having a greater thickness than said periphery and comprising a corrugated laminate, said corrugated laminate having one smooth outer ply and one inner ply joined thereto, said inner ply comprising a corrugated medium having equally spaced corrugations throughout, said food container being multi-planar and having first and second portions spaced apart in the Z-direction, said first and second portions being connected by a continuous transition region.

6. A multi-ply food container according to claim 5 wherein said central region is concave-shaped.

7. A multi-ply food container having an XY plane and a Z-direction orthogonal thereto, said food container comprising at least three plies, each said ply being adhesively joined to an adjacent ply wherein said food container comprises a laminate, said laminate forming a central region of said food container spaced apart in the Z-direction from the entirety of a circumjacent periphery, said entire central region being thicker than said periphery, said central region having two smooth outer plies and an inner ply therebetween, said inner ply comprising spacers, said spacers being equally spaced apart from one another throughout said XY plane, said first ply and said third ply being joined to said spacers so that said first ply and said third ply are disposed on opposed faces of said food container in said Z-direction, said food container being multi-planar and having first and second portions spaced apart in the Z-direction, said first and second portions being connected by a continuous transition region.

8. A multi-ply food container according to claims 5, or 7 wherein said continuous transition region is free of fold lines, scores, cuts or perforations.

9. A multi-ply food container having at least four plies disposed in face-to-face relationship to provide a plurality of at least two inner plies between two outer plies to thereby form a laminate having a basis weight of 100–1000 grams per square meter, said plurality of inner plies each being corrugated and spacing said two outer plies apart from each other with corrugations, a central region and a peripheral region adjacent thereto, said entire central region being thicker than said peripheral region, said entire peripheral region being displaced from said central region in the Z-direction, said central region and said peripheral region being joined to one another without fold lines therebetween, whereby a continuous transition joins said central region and said peripheral region.

10. A multi-ply food container according to claim 9 wherein each said inner ply comprises a corrugated medium, so that said inner plies comprise first and second corrugated media.

11. A multi-ply food container according to claim 10 wherein said first corrugated medium and said second corrugated medium have different sized corrugations.

12. A multi-ply food container according to claim 9 wherein said central region is concave-shaped.

13. A multi-ply food container having an XY plane and a Z-direction orthogonal thereto, said multi-ply food container comprising three plies, a first ply, a second ply and a third ply, said three plies being disposed in a laminate having a basis weight of 100–1000 grams per square meter, whereby said second ply is interposed between said first ply and said third ply, whereby said first ply and said third ply are spaced apart from each other, said second ply providing for an air space between said first ply and said third ply, said food container being multi-planar and having first and second portions spaced apart in the Z-direction, said first and second portions being connected by a continuous transition region having a radius of curvature of 1 to 25 millimeters, said food container having a periphery defined by an edge, said edge of said food container being sealed whereby said air space between said first ply and said third ply is enclosed at the edge of the food container.

14. A multi-ply food container having an XY plane and a Z-direction orthogonal thereto, comprising at least three plies, said food container comprising a corrugated laminate having equally spaced corrugations throughout, said corrugated laminate having at least one smooth outer ply and an inner ply joined thereto, said inner ply comprising a wave flute corrugated medium, said food container being multi-planar and having first and second portions spaced apart in the Z-direction, said first and second portions being connected by a continuous transition region having a radius of curvature of at least 5 millimeters.

15. A multi-ply food container having an XY plane and a Z-direction orthogonal thereto, said food container comprising at least three plies wherein said food container comprises a laminate, said laminate having two smooth outer plies and an inner ply therebetween, said inner ply comprising spacers, said spacers being spaced apart from one another in said XY plane, said first ply and said third ply being joined to said spacers so that said first ply and said third ply are disposed on opposed faces of said food container in said Z-direction, said food container being multi-planar and having first and second portions spaced apart in the Z-direction, said first and second portions being connected by a continuous transition region, said spacers being selected from the group consisting of discrete spacers and honeycomb spacers.

16. A multi-ply food container having a central region and a peripheral region adjacent thereto, said peripheral region being displaced from said central region in the Z-direction, said central region and said peripheral region being joined to one another without fold lines therebetween, whereby a continuous transition region having a radius of curvature of at least 5 millimeters joins said central region and said peripheral region, said food container comprising two outer plies and two inner plies therebetween, each of said inner plies comprising a corrugated medium having equally spaced corrugations.

17. A multi-ply food container having an XY plane and a Z-direction orthogonal thereto, said multi-ply food container comprising a periphery and a central region, said periphery being spaced apart in said Z-direction from said central region, said multi-ply food container comprising three plies, a first ply, a second ply, and a third ply, said second ply being interposed between said first ply and said third ply whereby said first ply and said third ply are spaced apart from each other, each said ply of said laminate being adhesively joined to an adjacent ply, said second ply providing for an air space between said first ply and said third ply, said food container having first and second portions spaced apart in the Z-direction by spacing means, said spacing means being equally spaced apart in said XY plane, said first and second portions being connected by a continuous transition region having a radius of curvature of 1–25 millimeters.

18. A multi-ply food container having an XY plane and a Z-direction orthogonal thereto, said multi-ply food container having a basis weight of 100–1000 grams per square meter and comprising a periphery and a central region, said periphery being spaced apart in said Z-direction from said central region, said multi-ply food container comprising three plies, an outer first ply, an intermediate second ply, and an outer third ply, said second ply being interposed between said first ply and said third ply whereby said first ply and said third ply are spaced apart from each other, said second ply providing for an air space between said first ply and said third ply, said food container having no intermediate synthetic plies, said food container having first and second portions spaced apart in the Z-direction, said first and second portions being connected by a continuous transition region having a radius of curvature of at least 5 millimeters.

19. A multi-ply food container having an XY plane and a Z-direction orthogonal thereto, said multi-ply food container having a basis weight of 100–1000 grams per square meter and comprising at least three plies, each said ply of said food container being adhesively joined to an adjacent ply, said food container having a periphery and a central region, said periphery being spaced apart in said Z-direction from said central region, said central region comprising a corrugated laminate having at least one smooth outer ply and an inner ply joined thereto, said inner ply comprising a corrugated medium, said food container having first and second portions spaced apart in the Z-direction, said first and second portions being connected by a transition region having a radius of curvature of 1–25 millimeters.

20. A multi-ply food container having an XY plane and a Z-direction orthogonal thereto, said multi-ply food container comprising at least three cellulosic plies and no synthetic plies and having a periphery and a central region, said periphery being spaced apart in said Z-direction from said central region, said central region comprising a corrugated laminate having at least one smooth outer ply and an inner ply joined thereto, said inner ply comprising a corrugated medium having equally spaced corrugations throughout, said food container having first and second portions spaced apart in the Z-direction, said first and second portions being connected by a transition region having a radius of curvature of at least 5 millimeters.

* * * * *

UNITED STATES PATENT AND TRADEMARK OFFICE

CERTIFICATE OF CORRECTION

PATENT NO. : 6,491,214 B2
DATED : December 10, 2002
INVENTOR(S) : Wendy L. Plummer et al.

It is certified that error appears in the above-identified patent and that said Letters Patent is hereby corrected as shown below:

Column 10,
Line 3, after "claims," insert -- 1, --.

Signed and Sealed this

Twenty-fourth Day of June, 2003

JAMES E. ROGAN
*Director of the United States Patent and Trademark Office*